US006616472B2

(12) United States Patent
Lee

(10) Patent No.: US 6,616,472 B2
(45) Date of Patent: Sep. 9, 2003

(54) ELECTRIC COUPLER FOR ELECTRIC FACILITIES

(76) Inventor: Hsueh Chung Lee, P.O. Box 10-69, Chong Ho, Taipei (TW), 235

( * ) Notice: Subject to any disclaimer, the term of this patent is extended or adjusted under 35 U.S.C. 154(b) by 0 days.

(21) Appl. No.: 10/066,117

(22) Filed: Jan. 31, 2002

(65) Prior Publication Data

US 2003/0143883 A1 Jul. 31, 2003

(51) Int. Cl.[7] ..... H01R 13/625
(52) U.S. Cl. ..... 439/342; 439/701
(58) Field of Search ..... 439/342, 374, 439/376, 701, 343, 378

(56) References Cited

U.S. PATENT DOCUMENTS 5,137,462 A * 8/1992 Casey et al. ..... 439/74
5,486,118 A * 1/1996 Colleran et al. ..... 439/374
5,913,703 A * 6/1999 Suzuki et al. ..... 439/701
6,146,210 A * 11/2000 Cha et al. ..... 439/680
6,386,899 B1 * 5/2002 Ushio et al. ..... 439/374

* cited by examiner

*Primary Examiner*—Hien Vu

(57) ABSTRACT

An electric coupler includes a socket device for coupling to an electric power source and having a pair of channels formed in a base and having a pair of passages, and a pair of conductors engaged in the channels of the base. A plug device includes a seat having a pair of conduits for receiving two prongs, and a pair of ears detachably engaged into the passages of the socket device for detachably securing the plug device to the socket device. The prongs may be shielded by the plug device and may be prevented from being contacted or touched by the children inadvertently.

5 Claims, 5 Drawing Sheets

ELECTRIC COUPLER FOR ELECTRIC FACILITIES

BACKGROUND OF THE INVENTION

1. Field of the Invention

The present invention relates to an electric coupler, and more particularly to an electric coupler for coupling electric facilities to electric power sources.

2. Description of the Prior Art

Typical electric couplers for coupling electric facilities to electric power sources comprise a socket provided on the wall, and a plug coupled to the electric facility for plugging to the sockets. The prongs of the plugs are exposed and will be contacted by children inadvertently, such that the children may be hurt by the electric energy inadvertently.

The present invention has arisen to mitigate and/or obviate the a fore-described disadvantages of the conventional electric couplers.

SUMMARY OF THE INVENTION

The primary objective of the present invention is to provide an electric coupler for coupling electric facilities to electric power sources without exposing the conductive conductors or prongs.

In accordance with one aspect of the invention, there is provided an electric coupler comprising a socket device for coupling to an electric power source, the socket device including a base having a pair of channels formed therein, and including a pair of passages formed therein, a pair of conductors engaged in the channels of the base respectively, a plug device including a seat having a pair of conduits formed therein, and including a pair of ears detachably engaged into the passages of the socket device for detachably securing the plug device to the socket device, and a pair of prongs engaged in the conduits of the plug device, and including a first end extended outward of the plug device for engaging into the channels of the base respectively and for electrically coupling to the conductors respectively. The prongs may be shielded by the plug device and will not be exposed in order to be prevented from being contacted or touched by the children inadvertently, and so as to avoid the children from being damaged by electric power source inadvertently.

The socket device includes a block and two caps secured on top of the base, the caps each includes a front edge extended forward beyond the block and each having one of the passages of the socket device formed therein.

The block includes a flap extended upward therefrom for engaging with the plug device and for aligning the ears of the plug device with the passages of the socket device.

The base includes a pair of socket openings formed therein, the conductors each includes a U-shaped socket member formed and provided thereon and received in the socket openings of the base respectively and each having a groove formed therein.

The plug device includes a housing and a casing secured on top of the seat, and each having a protrusion extended therefrom and each having the ears extended from the protrusion thereof.

The housing includes at least one passageway formed therein, and includes a notch formed therein, an electric wire is further provided and engaged into the notch and the passageway of the housing and is electrically coupled to the prongs.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
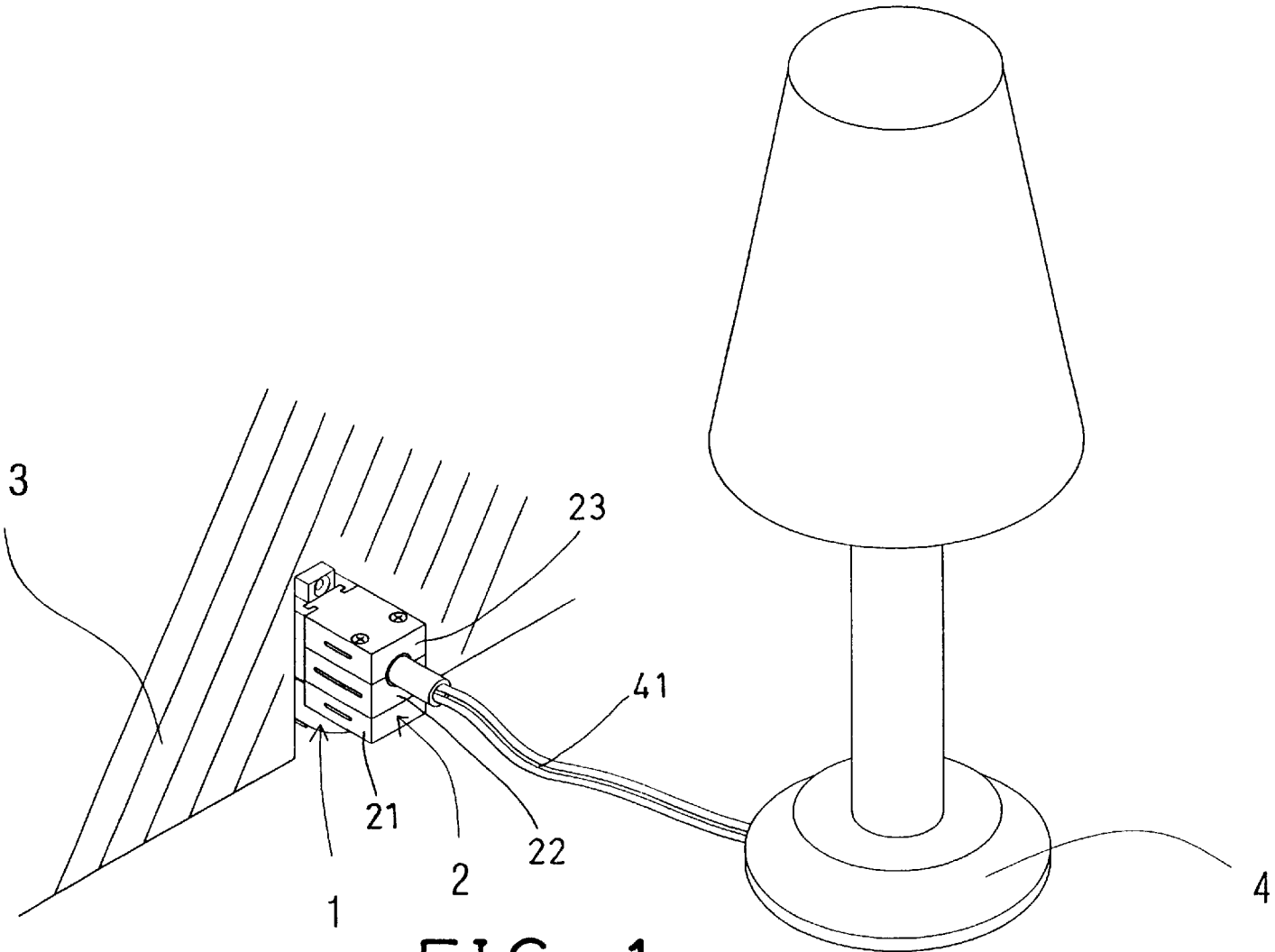
FIG. 1 is a perspective view illustrating the operation of an electric coupler in accordance with the present invention.
Figure 2:
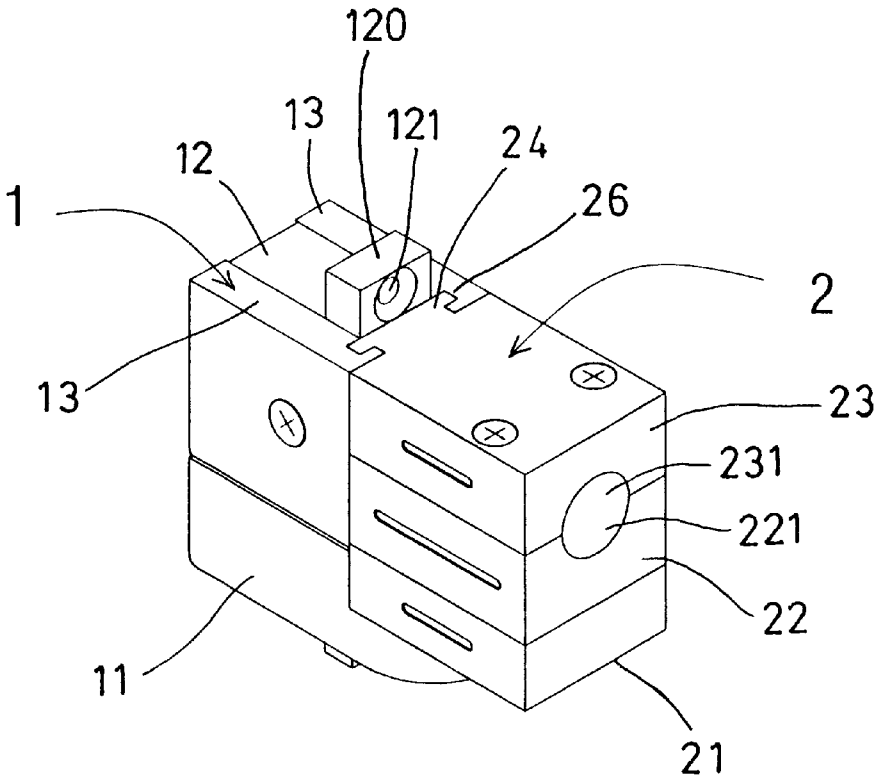
FIG. 2 is a perspective view of the electric coupler.
Figure 3:
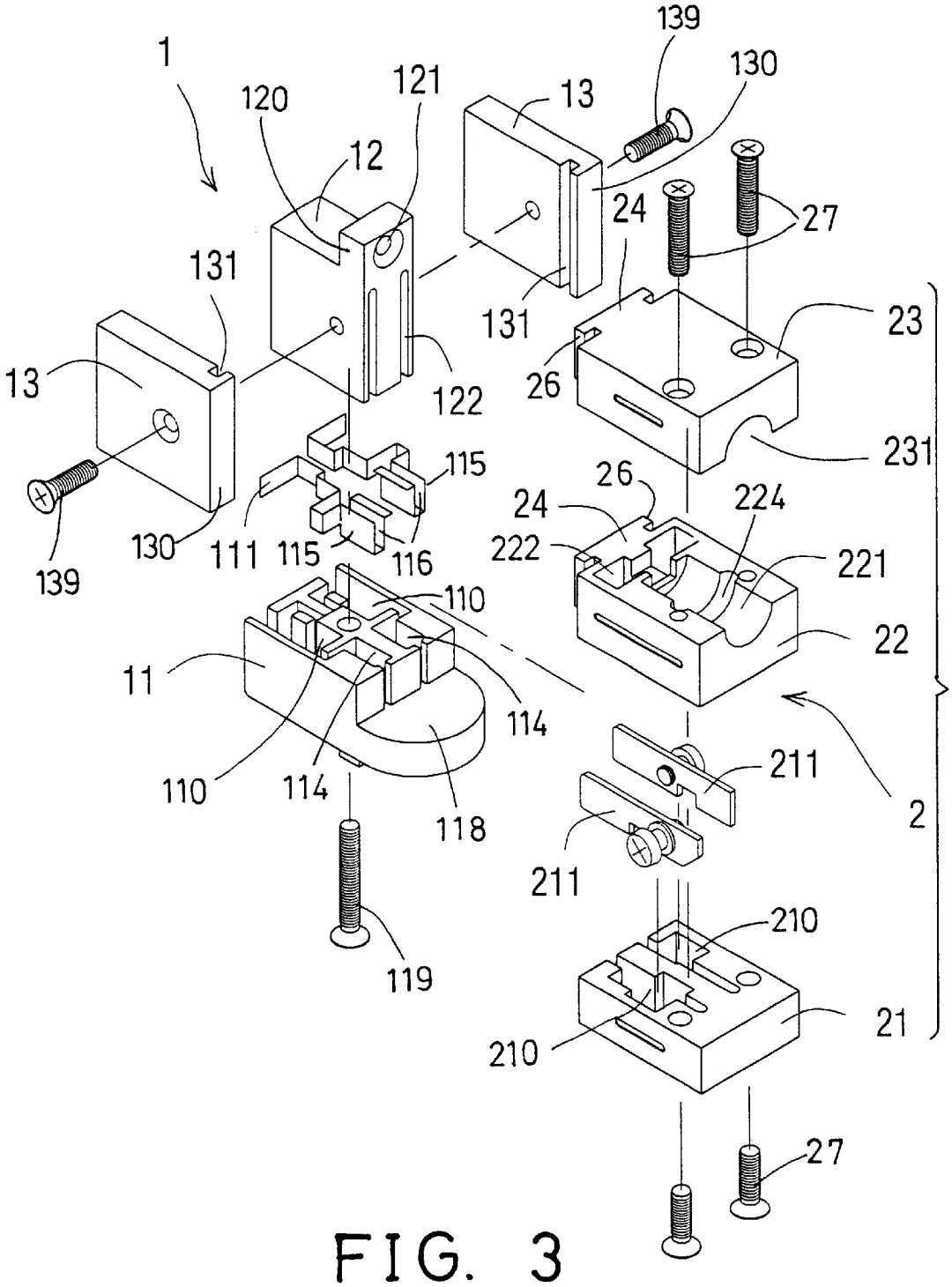
FIG. 3 is an exploded view of the electric coupler.
Figure 5:
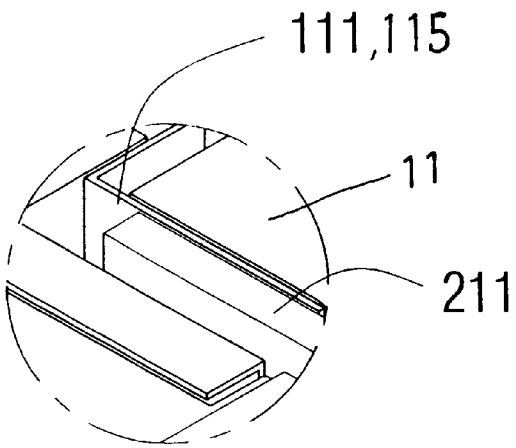
FIG. 5 is an enlarged partial perspective view of the electric coupler.
Figure 4:
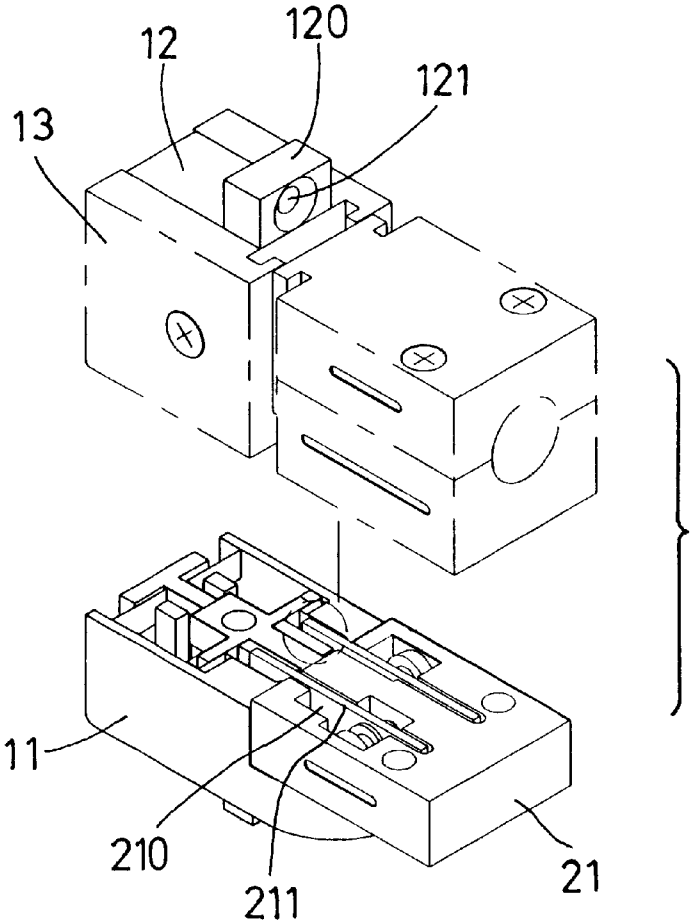
FIG. 4 is a partial exploded view of the electric coupler.

Referring to the drawings, and initially to FIGS. 1–3, an electric coupler in accordance with the present invention comprises a socket device 1 to be secured in a wall member 3 (FIG. 1) or the like and to be coupled to the electric power source, and a plug device 2 to be coupled to an electric facility 4 with a cable 41, and to be electrically coupled to the socket device 1 for electrically coupling the electric facility 4 to the electric power source. Both the socket device 1 and the plug device 2 have no conductors or prongs to be exposed and to be touchable or contactable by the children inadvertently.

The socket device 1 includes a base 11 having two channels 110 and two socket openings 114 formed therein for receiving a pair of conductors 111 respectively, and having a notch 118 formed therein and communicating with the socket openings 114 thereof. The conductors 111 each includes a U-shaped socket member 115 formed and provided on one end thereof and received in the socket openings 114 of the base 11 respectively and each having a groove 116 formed therein. A block 12 is secured on top of the base 11 with one or more fasteners 119, and includes a flap 120 extended upward from the front portion thereof and having an orifice 121 formed therein, and includes a pair of slots 122 formed therein. Two caps 13 are secured to the sides of the block 12 with fasteners 139, and each includes a front edge 130 extended forward beyond the block 12, and each includes a passage 131 formed therein.

The plug device 2 includes a seat 21 having two conduits 210 formed therein for receiving two prongs 211 therein respectively. The prongs 211 include one end extended outward of the seat 21 for engaging into the socket openings 114 of the base 11 and for electrically coupling to the conductors 111 respectively. A housing 22 and a casing 23 are secured on the seat 21 with fasteners 27, and each includes a notch 221, 231 formed in one end thereof for receiving the electric cable 41 therein, and each includes a protrusion 24 and a pair of ears 26 extended and provided in the other end thereof for engaging into the passages 131 of the caps 13 and for detachably coupling the plug device 2 to the socket device 1. The housing 22 includes one or more passageways 222, 224 formed therein. The electric cable 41 may have one end engaged through either of the passageways 222, 224 of the housing 22 and electrically secured and coupled to the prongs 211 respectively.

It is to be noted that the protrusion 24 and the ears 26 of the plug device 2 may be engaged with the flap 120 of the block 12 first, for aligning purposes, and for allowing the ears 26 of the plug device 2 to be precisely engaged into the passages 131 of the caps 13.

Figure 7:
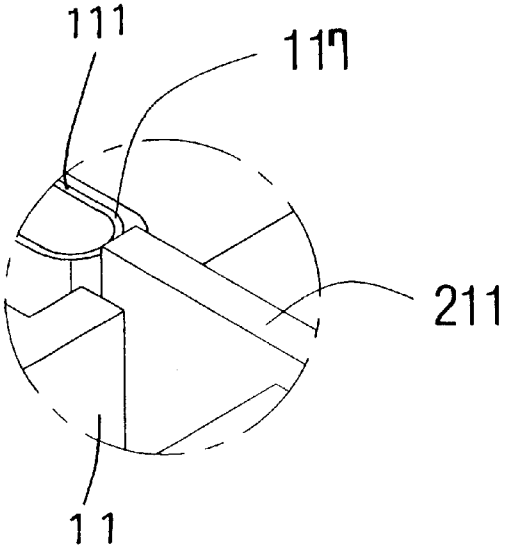
FIG. 7 is an enlarged partial perspective view illustrating the operation of the electric coupler as shown in FIG. 6.
Figure 6:
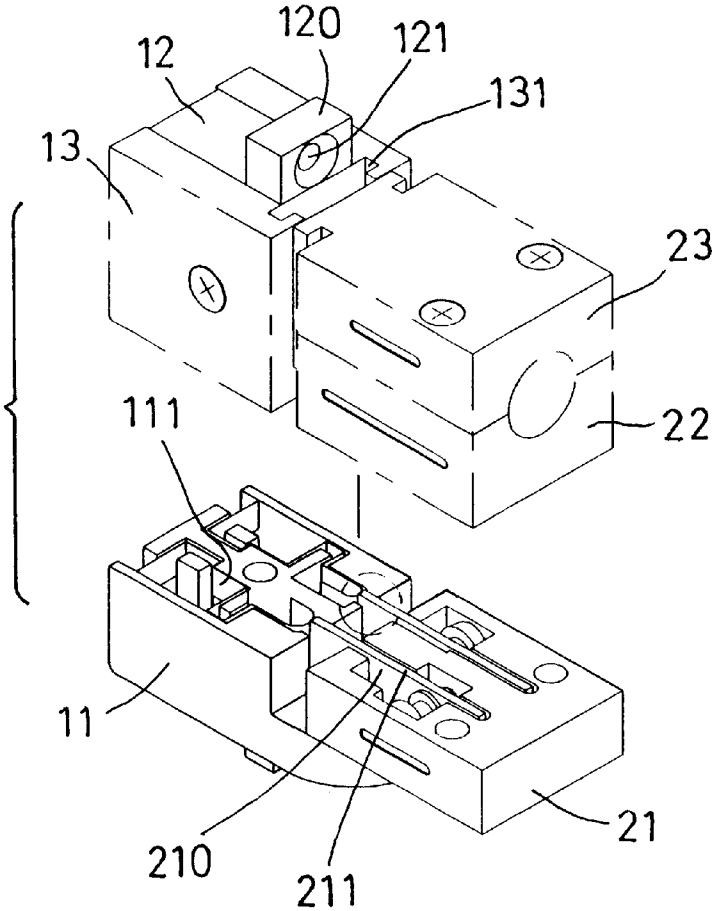
FIG. 6 is a partial exploded view of the electric coupler similar to FIG. 4, illustrating the operation of the electric coupler.

In operation, as shown in FIGS. 4–8, the prongs 211 may be engaged into the socket openings 114 of the base 11, and/or the grooves 116 of the conductors 111, by engaging the seat 21 onto the base 11. The protrusions 24 and the ears 26 of the plug device 2 may then be engaged into the passages 131 of the caps 13 for detachably coupling the plug device 2 to the socket. device 1. The prongs 211 may thus be maintained in the electric contact or engagement with the conductors 111, by the engagement of the ears 26 of the plug device 2 in the passages 131 of the caps 13. The prongs 211 may be shielded by the plug device 2 and will not be contacted by the children inadvertently, As shown in FIGS. 6 and 7, the conductors 111 may each include a curved portion 117 for facilitating the engagement or the contact of the prongs 211 with the conductors 111 respectively.

Accordingly, the electric coupler in accordance with the present invention may be used for coupling electric facilities to electric power sources without exposing the conductive conductors or prongs.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An electric coupler comprising:

a socket device for coupling to an electric power source, said socket device including a base having a pair of channels formed therein, and including a pair of passages formed therein, and including a block and two caps secured on top of said base, said caps each including a front edge extended forward beyond said block and each having one of said passages of said socket device formed therein, a pair of conductors engaged in said channels of said base respectively, a plug device including a seat having a pair of conduits formed therein, and including a pair of ears extending outwardly from a front wall of the seat and detachably engaged into said passages of said socket device for detachably securing said plug device to said socket device, and a pair of prongs engaged in said conduits of said plug device, and including a first end extended outward of said plug device for engaging into said channels of said base respectively and for electrically coupling to said conductors respectively.

2. The electric coupler according to claim 1, wherein said block includes a flap extended upward therefrom for engaging with said plug device and for aligning said ears of said plug device with said passages of said socket device.

3. The electric coupler according to claim 1, wherein said base includes a pair of socket openings formed therein, said conductors each includes a U-shaped socket member formed and provided thereon and received in said socket openings of said base respectively and each having a groove formed therein.

4. The electric coupler according to claim 1, wherein said plug device includes a housing and a casing secured on top of said seat, and each having a protrusion extended therefrom and each having said ears extended from said protrusion thereof.

5. The electric coupler according to claim 4, wherein said housing includes at least one passageway formed therein, and includes a notch formed therein, an electric wire is further provided and engaged into said notch and said at least one passageway of said housing and is electrically coupled to said prongs.

* * * * *